US009022761B2

(12) United States Patent
Flavelle

(10) Patent No.: US 9,022,761 B2
(45) Date of Patent: May 5, 2015

(54) ELLIPTICAL GEAR PUMP FLUID DRIVING APPARATUS

(75) Inventor: William D. Flavelle, Hoschton, GA (US)

(73) Assignee: Roper Pump Company, Commerce, GA (US)

( * ) Notice: Subject to any disclaimer, the term of this patent is extended or adjusted under 35 U.S.C. 154(b) by 222 days.

(21) Appl. No.: 13/591,884

(22) Filed: Aug. 22, 2012

(65) Prior Publication Data

US 2014/0056746 A1 Feb. 27, 2014

(51) Int. Cl.

| | |
|---|---|
| ***F01C 1/18*** | (2006.01) |
| ***F01C 1/24*** | (2006.01) |
| ***F03C 2/00*** | (2006.01) |
| ***F03C 4/00*** | (2006.01) |
| ***F04C 2/00*** | (2006.01) |
| ***F04C 2/08*** | (2006.01) |
| ***F04C 2/18*** | (2006.01) |
| ***F04C 15/00*** | (2006.01) |

(52) U.S. Cl.

CPC . *F04C 2/084* (2013.01); *F04C 2/18* (2013.01); *F04C 15/0019* (2013.01); *F04C 15/0026* (2013.01); *F04C 2250/20* (2013.01)

(58) Field of Classification Search

CPC ..... F04C 2/18; F04C 2/344; F04C 18/344; F04C 15/0026; F04C 15/0019; F04C 2250/20; F01C 21/0836; F01C 21/0845

USPC ..... 418/192, 134, 190–191, 131–133, 259, 418/201.1, 201.3, 206.1, 206.5

See application file for complete search history.

(56) References Cited

U.S. PATENT DOCUMENTS

| | | | | | |
|---|---|---|---|---|---|
| 67,978 | A | * | 8/1867 | Hanford | 418/191 |
| 1,436,263 | A | * | 11/1922 | Johnson | 418/134 |
| 1,923,268 | A | * | 8/1933 | Jensen | 418/206.1 |
| 2,134,153 | A | * | 10/1938 | Ludwig | 418/134 |
| 2,210,152 | A | * | 8/1940 | Sacha | 418/134 |
| 2,349,022 | A | * | 5/1944 | Ungar et al. | 418/201.1 |
| 2,897,765 | A | | 8/1959 | Kitano | |
| 3,306,228 | A | * | 2/1967 | Drutchas | 418/192 |
| 3,511,584 | A | | 5/1970 | Vierling | |
| 5,297,945 | A | | 3/1994 | Loubier et al. | |
| 6,048,186 | A | | 4/2000 | Kitano | |
| 6,599,113 | B1 | | 7/2003 | Lee | |
| 7,246,734 | B2 | | 7/2007 | Shelton, IV | |

FOREIGN PATENT DOCUMENTS

| | | | | |
|---|---|---|---|---|
| WO | WO 9601950 | A1 * | 1/1996 | F04C 2/08 |

* cited by examiner

*Primary Examiner* — Theresa Trieu

(74) *Attorney, Agent, or Firm* — Caesar Rivise, PC

(57) ABSTRACT

Elliptical or oval shaped gears of a positive displacement gear pump are disclosed. The gears have specially designed teeth at the ends of the gears' major and minor diameter axes. For example the teeth at the ends regions of the major diameter axes include radially extending wipers or vanes that extend and run against the circular gear case bore walls to seal liquid slip paths at radial running clearance areas between the tips of the gear teeth and the case bores. The pump may also have moveable wearplates on one or both sides of the gears that may be loaded laterally to seal liquid slip paths at lateral running clearance areas between the side faces of the gears and the pump faceplate and backplate.

23 Claims, 5 Drawing Sheets

ELLIPTICAL GEAR PUMP FLUID DRIVING APPARATUS

BACKGROUND OF THE INVENTION

1. Field of Invention

This invention relates generally to gears used in pumps for liquids, and more particularly, to gears of positive displacement gear pumps.

2. Description of Related Art

Typical spur gear pumps are not very efficient when handling low viscosity liquids. As viscosity decreases, internal slip within the pump increases. Thus in common spur gear pumps, low viscosity liquids slip or flow backwards around the gears through clearance areas between the gears, or gear wheels, and interior walls of their housing. This slippage reduces output flow of the liquids. U.S. Pat. No. 5,297,945 to Loubier, et al. discloses a pump with oval or elliptical gears for viscous liquids such as syrups, etc. The pump is not very efficient for lower viscosity liquids because discharge pressure causes much of the fluid to flow backwards past the pumping gears. In addition, liquid displacement is limited to the size or length of the gears.

Spur gear and helical gear pumps displace a volume of liquid per revolution that is equivalent to the volume of all the intermeshing teeth of the gears in a full rotation of 360°. The volume has practical limits in relation to the size and number of teeth that given gear diameter can accommodate. U.S. Pat. No. 6,048,186 to Kitano discloses elliptic gear wheels with larger teeth at the ends of the major axis. However, this pump is also not very efficient for lower viscosity liquids. Further, the pump volume is limited to the length along the major diameter axis.

The inventor has realized a benefit to efficiently seal and displace low viscosity fluids. Some examples of relatively low viscosity liquids include water, ethanol, milk, kerosene, diesel fuel, etc.

All references cited herein are incorporated herein by reference in their entireties.

BRIEF SUMMARY OF THE INVENTION

This summary is provided to introduce a selection of concepts in a simplified form that are further described below in the detailed description. This summary is not intended to identify essential features of the claimed subject matter, nor is it intended for us in determining the scope of the claimed subject matter.

In accordance with an example of the invention, a pump fluid driving apparatus is provided with a housing having a first body plate with a first circular wall section and a second body plate with a second circular wall section, with the first and second circular wall sections defining a chamber, and first and second gears within the chamber. The gears are disposed adjacent a respective generally circular wall section and mounted onto respective axles for rotation about their centers. The gears are identical to each other with teeth located about their periphery and operatively positioned with the teeth of the gears intermeshed for all angular positions in a rotation of the gears. At least one of the teeth from each of the first and second gears includes a radially extending vane in sealing contact with the respective circular wall sections.

In another example of the invention, the select gears having radially extending vanes also include a vane slot extending radially within each of the gears, with the radially extending vane movable within the respective vane slot and extending radially beyond the teeth. A biasing member may be disposed within the vane slot and against the radially extending vane to urge the vane toward the respective generally circular wall section. While not being limited to a particular theory, the gears are preferably elliptical or oval in shape, and having a respective major diameter axis. The teeth located about the periphery of the gear in the region of the major axis may be wider than other teeth that are not along the major axis. Preferably the wider teeth are the teeth that include the radially extending vans. In order to increase the fluid volume, the chamber defined by the generally circular wall sections has a diameter greater than any diameter of the gears.

In another example of the invention, floating side plate members are laterally disposed about the gears to seal off liquid within the gear chamber. The floating side plate member may include a fluid restricting plate sealingly fitted against the chamber, and a biasing unit urging the fluid restricting plate against the gears. This example may also include a second side plate member sealingly fitting to the chamber against the gears opposite the floating side plate member to seal the pump fluid within the chamber.

In another example of the invention, a fluid drive apparatus configured to increase output flow of low viscosity liquids by minimizing radial clearance slip paths in a spur gear pump is provided, with the apparatus including a housing, first and second gears, and vanes. The housing may have a first body plate with a first circular wall section and a second body plate with a second circular wall section, with the first and second circular wall sections defining a chamber. The gears are identical in shape and mounted for rotation about respective axes within the chamber centered to each of the generally circular wall sections. The gears preferably have teeth located about their periphery and operatively positioned with the teeth intermeshed for all angular positions in a rotation of the gears. In this example, at least one of the teeth from each of the gears includes a vane extending radially beyond the tooth and into sealing contact with the respective generally circular wall section. While not being limited to a particular theory, the vane may be moveable within the tooth of the gear to retreat when the teeth is intermeshed with the other gear.

BRIEF DESCRIPTION OF SEVERAL VIEWS OF THE DRAWINGS

The invention will be described in conjunction with the following drawings in which like reference numerals designate like elements, and wherein.

DETAILED DESCRIPTION OF THE PREFERRED EMBODIMENTS

Figure 1:
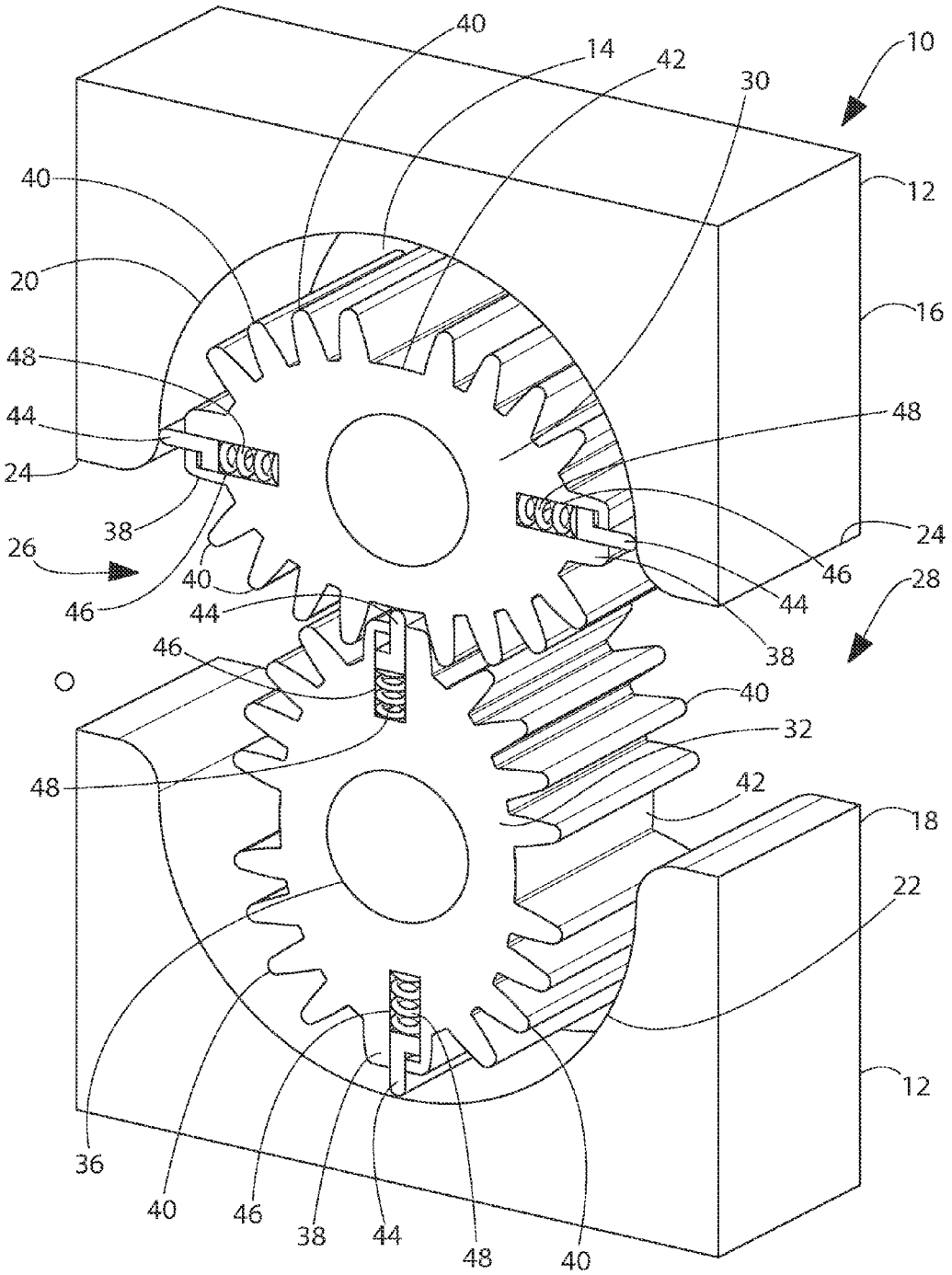
FIG. 1 is a perspective view of a fluid driving apparatus of a pump or flow meter in accordance with examples of the invention.

The exemplary embodiments for the pump fluid driving apparatus are described with reference to FIGS. 1-3. While not being limited to a particular theory, in general, the exemplary embodiments include elliptical or oval gears with specially cut teeth at the ends of the major and minor diameter axis. The teeth at the ends of the major axis may be wide enough to help seal the radial clearance path between the teeth and the circular walls of the housing. The teeth may also be substantial enough to carry radial floating vanes that extend and run against the circular walls of the case bore or chamber to effectively seal off radial slip paths. These vanes provide the benefit of effectively sealing the circumferential slip path around the gears while maintaining an intermeshed relationship with the other gear in the chamber. The elliptical shape of the gears allows a much larger volume of liquid to be displaced in every revolution of the pump compared to spur gears having the same major diameter. However it is understood that the invention is not limited to elliptical or oval shaped gears and may apply to gears having other shapes. Moreover, not only are the volumes of liquid between the gear teeth transported around and displaced in each revolution, but also additional volumes of liquid in the swept segments between the gears and the case bores (circular walls) may further be displaced by the vanes. Pressure loaded plates can also be fitted into the pump on both sides of the gears to effectively seal the lateral slip paths on the sides of the gears.

Other advantages, characteristics and details of the invention will emerge from the explanatory description provided below with reference to the attached drawings and examples, but it should be understood that the present invention is not deemed to be limited thereto. To that end, FIG. 1 depicts an exemplary pump fluid driving apparatus 10. The pump fluid driving apparatus 10 includes a main body as a housing 12 having first and second body plates 16, 18 providing a gear chamber 14 defined by first and second circular wall sections 20, 22. The two circular wall sections are positioned with the housing 12 and include two spaced apertures 24 that communicate with an inlet 26 and an outlet 28 in the housing. While the housing 12 is depicted by example as having two separate body plates 16 and 18, it is understood that the housing 12 may be a single unit with spaced apertures 24 represented through the housing as the inlet 26 and outlet 28. As such, the inlet 26 and outlet 28 are not limited by their size or shape, but by their location on opposite sides of the gear chamber 14 in the preferred examples.

The spaced apertures 24 register with the inlet 26 and the outlet 28, with the inlet being open to an inlet passage of the pump, and the outlet being open to an outlet passage of the pump. The gear chamber 14 is closed on its front and rear side for a fluid tight seal with the body plates 16, 18 of the housing 12 in this example, as understood by a skilled artisan.

Figure 2:
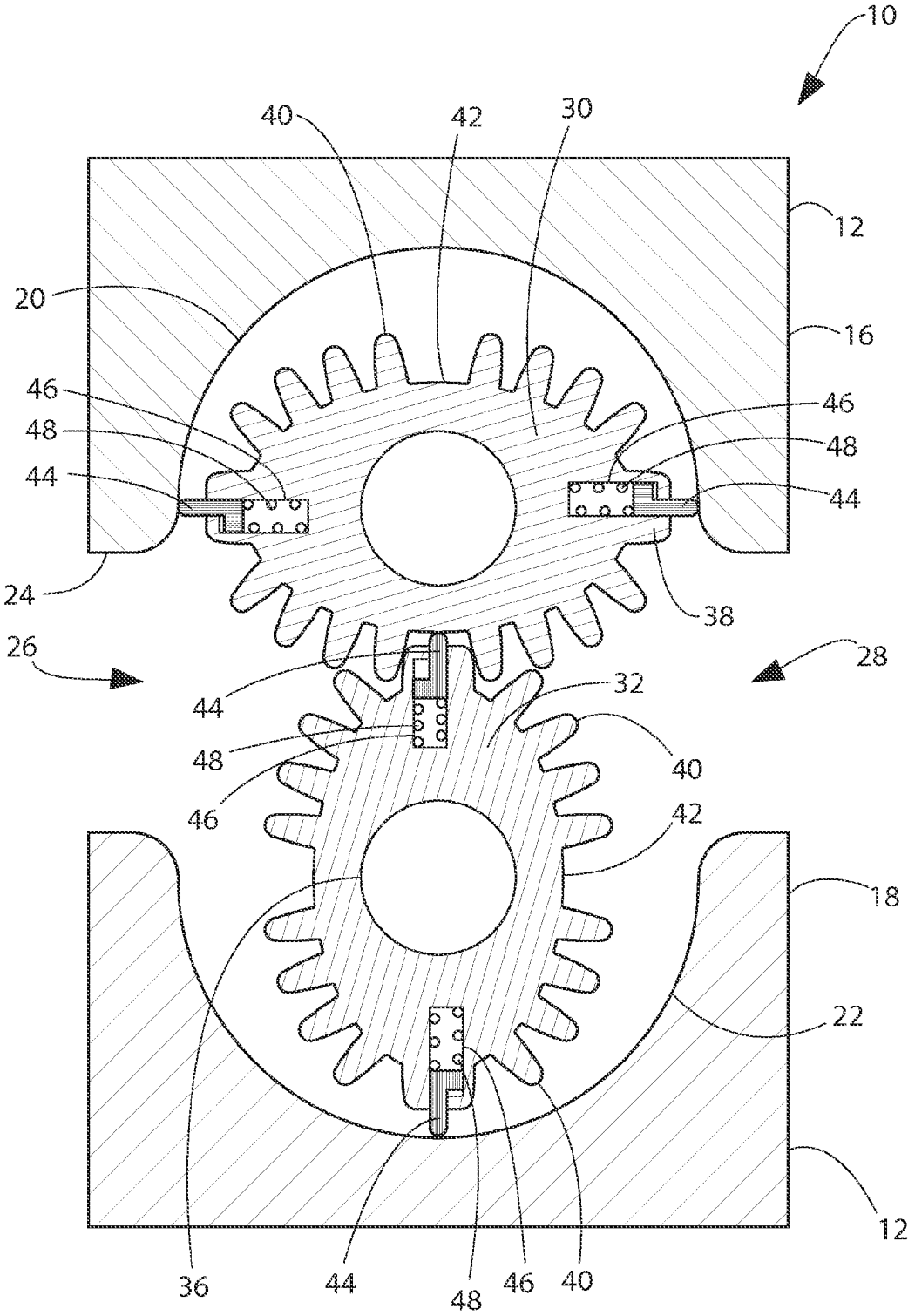
FIG. 2 is a side view of the driving apparatus illustrated in FIG. 1.

Still referring to FIGS. 1 and 2, a pair of gears 30, 32 are journaled in the gear chamber 14. The gear 30 is mounted for rotation about an axis rod or axle 34 (FIG. 2) at its center, which corresponds with the center of curvature of the circular wall section 20. The gear 32 is mounted for rotation about an axle 36 (FIG. 2), which is disposed at the center of curvature of the circular wall section 22.

The two gears 30, 32 have peripheral teeth that intermesh so that the rotation of one of the gears, for example, gear 30 that may be linked to a pump motor, causes rotation of the other gear. The teeth of the gears 30, 32 may have different sizes, yet are machined to intermesh for all angular positions in a rotation of the gears. In this example, each gear has teeth 38 at the ends of the gears' major diameter axis that may be larger (e.g., wider, broader) than teeth 40, which are not at the end regions of the major axis. The larger teeth 38 may be formed to provide a profile with a radii or curvature approximately equal to the radii or curvature of the circular wall sections 20, 22. It is also noted that the gears 30, 32 are provided with gaps 42 between adjacent teeth 40 at the ends of the minor diameter axis in order to intermesh with the larger teeth 38 during rotation of the gears.

Still referring to FIGS. 1 and 2, the larger teeth 38 at the ends of the major diameter axis include radially extending wipers or vanes 44 that seal liquid slip paths (e.g., radial running clearance areas) that typically exist between the outer ends of the larger gear teeth 38 and the case bore defined by the circular wall sections 20, 22. While not being limited to a particular theory, the radially spaced vanes 44 are disposed within and extend out of respective vane slots 46 formed in the larger teeth 38 and extending within the gears toward the respective axle or shaft 34, 36. Centrifugal force and/or an outward bias that may be provided by, for example, springs 48 within the vane slots 46, urge each vane 44 radially outward into contact with the circular wall sections 20, 22. It is understood that gear rotation is required for centrifugal force to urge the vanes outward, while compression springs 46 may be preferred to urge the vanes outwards regardless of rotation.

During operation, fluid is drawn from the inlet 26 into an increasing volume defined by the circular wall sections 20, 22, the gears 30, 32 and the vanes 44. The drawn fluid is swept by the intermeshing gears 30, 32 and vanes 44 across a channel rotating with the respective gear 30, 32 within the circular wall sections to the outlet 28 where it is forced out of the housing 12. During the rotation of the gears, 30, 32, the vanes 44 are extended, preferably to the circular wall section, to help seal the radial clearance slip path, and during intermeshing, the vanes 44 are compressed against the centrifugal force and/or spring bias into the vane slot by the adjacent gear as the respective larger tooth 38 is intermeshed with the adjacent gear at the tooth gap 42.

Figure 5:
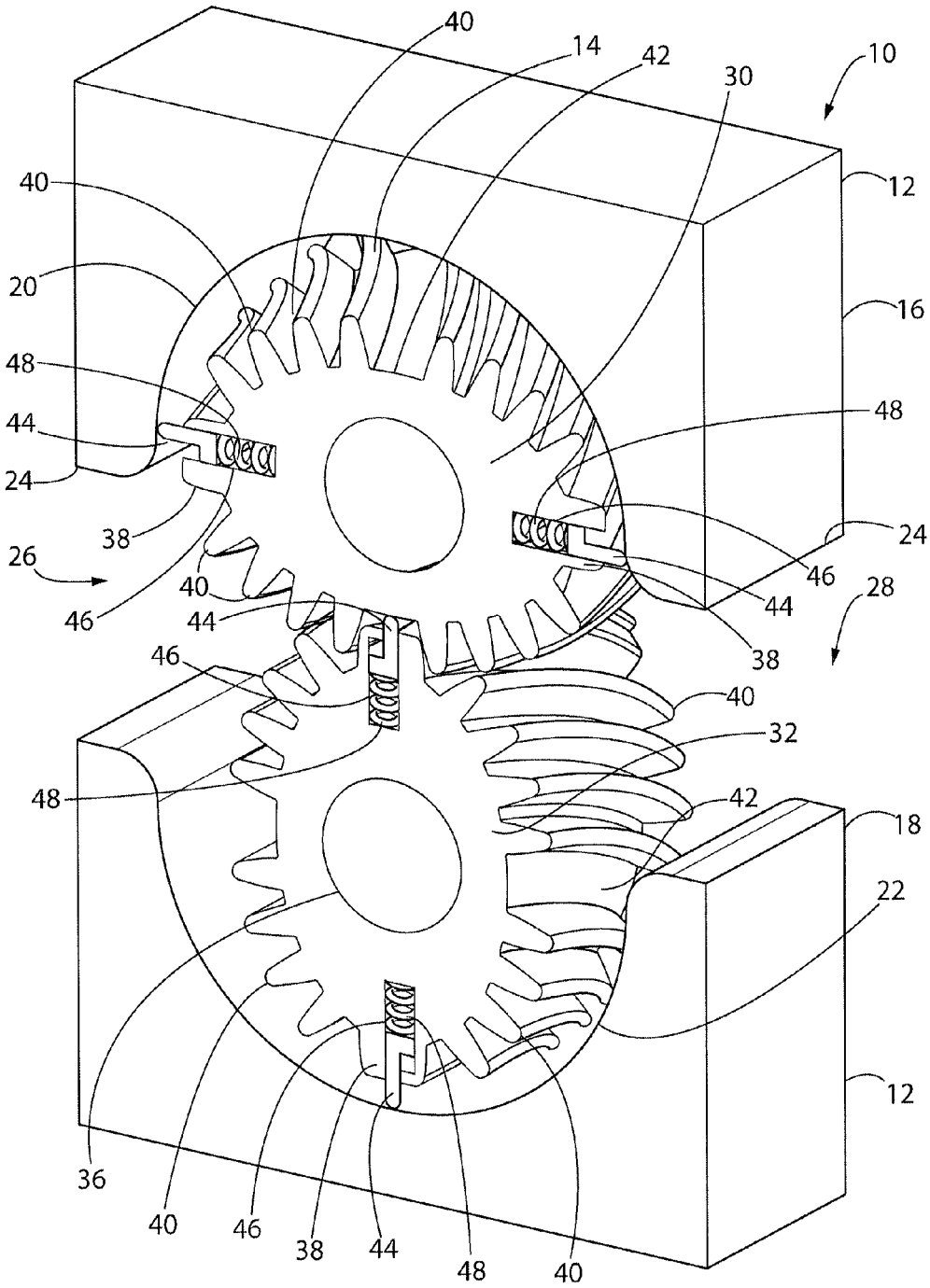
FIG. 5 is a perspective view of an exemplary fluid driving apparatus of a pump or flow meter with gears having helically oriented teeth.

It is also understood that the extendable vanes are not required to actually contact the surface of the tooth gap 42 of the adjacent gear during rotation. In particular, the extension length of the vanes 44 beyond the larger teeth 38 and the depth and shape of the tooth gaps 42 can be designed so the end of the vane never contacts the surface of the tooth gap when the gears 30, 32 mesh for spatial clearance between the vanes and tooth gaps at the ends of the minor diameter axis. It is further understood that the elliptical or oval gears in this invention preferably have either straight spur teeth or helically oriented teeth (FIG. 5), although the invention is not limited to these shapes.

Preferably the housing, gears 30, 32, vanes 44 and springs 48 are made of metal or other hard durable material, as readily understood by a skilled artisan. For example, the gears and vanes may preferably be made of stainless steel. The vanes may also be made of a resin, rubber or polypropylene. The springs 48 may most preferably be formed of a stainless steel or other material both strong and resilient to function as a biasing member.

Figure 3:
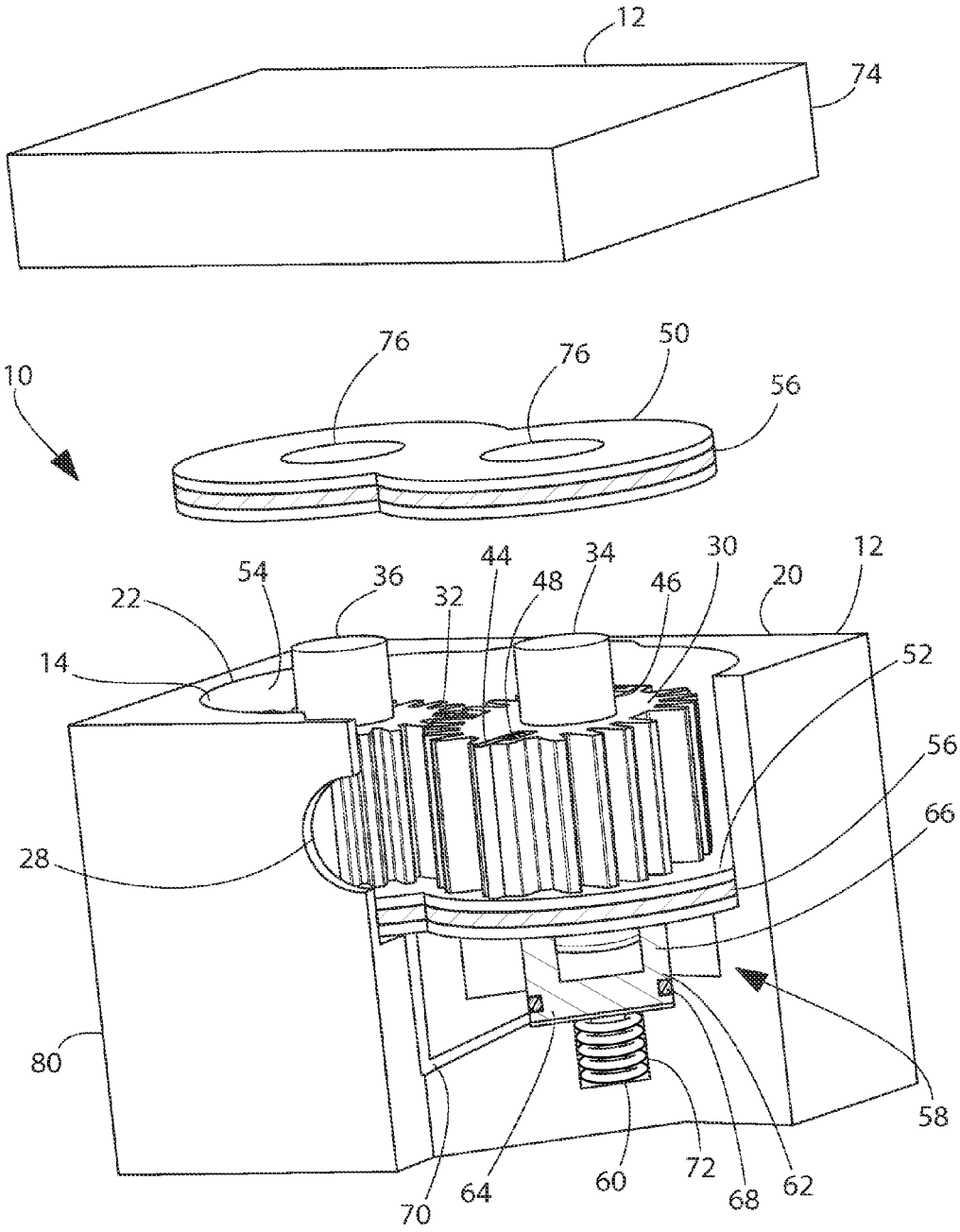
FIG. 3 is a perspective view, partially in section, of another exemplary fluid driving apparatus.

FIG. 3 depicts the fluid drive apparatus 10 in partly exploded perspective view. The exemplary apparatus is similar to the apparatus discussed above and depicted by example in FIGS. 1 and 2. The fluid drive apparatus 10 depicted in FIG. 3 further includes floating side plates added to seal off lateral slip paths on both sides of the gears 30, 32. The floating side plates 50, 52 are disposed within a housing bore 54 where the side plates are sealed against the circular wall sections 20, 22 to define the gear chamber 14 there between. The floating side plates 50, 52 are preferably made out of a metal or other hard durable material (e.g., stainless steel, resin, polyurethane, bronze, carbon, cast iron, etc.). The plates may include a gasket 56 wrapped about the radial periphery of the plates to help form the seal between the plates 50, 52 and the circular wall sections 20, 22. The plates 50, 52 also include aperture channels 76 that slide about the respective shafts 34, 36 and allow the plates to fit against the gears 30, 32 within the housing bore 54.

As can be seen in FIG. 3, the plates 50, 52 may be floating plates as they can slide transversely within the circular wall sections 20, 22 while maintaining a seal of the fluids within the gear chamber 14 regardless of the viscosity of the fluids. In order to keep a fluid tight relationship between the floating side plates 50, 52 with the gears 30, 32 there between, a bias may be applied to at least one of the side plates, as shown by example in FIG. 3. In particular, the side plate 52 may be biased toward the gears and side plate 50 by a biasing unit 58 in the housing 12. In this example, the biasing unit 58 includes a compression spring 60 in contact with a piston 62 adapted to apply a bias from the biasing unit 58 to the plate 52 without interfering with the shaft 34, which maybe a drive shaft. The piston 62 is a lateral clearance pressure piston including a disk wall 64 and a sleeve section 66 that slides about the shaft 34 without interfering with the rotation of the shaft, and abuts the floating slide plate 52. An o-ring 68 may be placed between the piston 62 and housing 12 to further prevent leakage.

To further maintain a balance bias against the piston 62, the housing 12 may be provided with a tunnel 70 providing fluid communication between the gear chamber 14 and a spring chamber 72 that houses the spring 60. Under pressure, for example, during pump operation, fluid from the gear chamber 14 may be forced under pressure into the spring chamber 72 to thereby hydraulically activate the piston 62 into the floating side plate 52 and further maintain a tight fitted relationship between the floating side plates 50, 52 opposite the gears 30, 32. When the pumping operation ceases, the relaxation of fluid pressure in the tunnel 70 and spring chamber 72 allows a relaxation of the bias against the floating slide plate 52, which may allow a cover 74 of the housing 12 to be safely removed for access to the gear chamber 14. However, it is beneficial that during use, the heightened fluid pressure provided during the pumping operation urges the floating side plates 50, 52 together to seal off lateral slip paths on the sides of the gears 30, 32.

Figure 4:
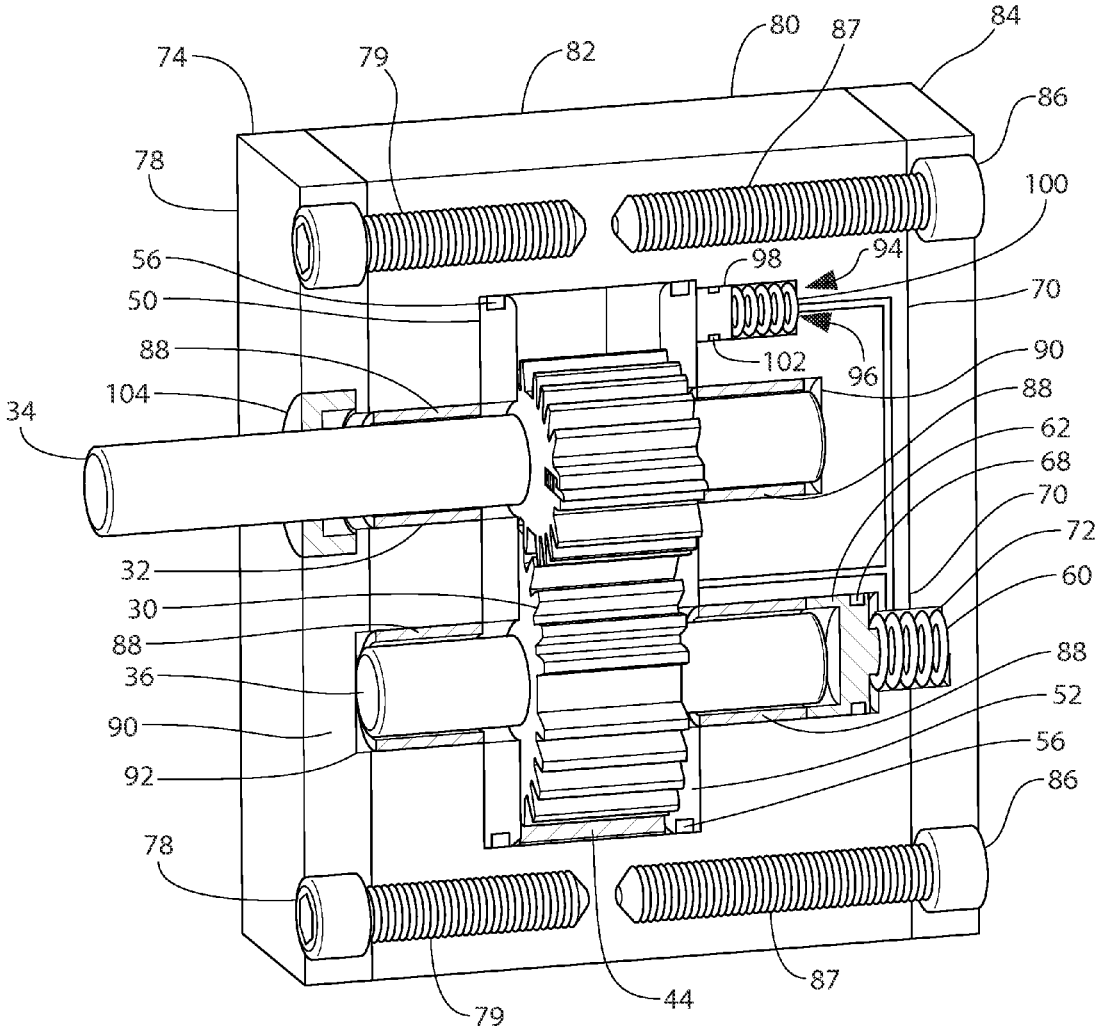
FIG. 4 is a perspective view, partially in section, of yet another exemplary driving apparatus in accordance with the invention.

The housing 12 preferably includes the cover 74 and a main body 80. While not being limited to a particular theory, the main body 80 may be a one-piece body (FIG. 3) or may include a plurality of pieces that combine to form the main body. FIG. 4 depicts an example of the fluid drive apparatus 10 with the main body 80 including a plurality of pieces. In particular, the main body 80 shown in FIG. 4 includes a center section 82 and a bottom section 84 coupled to the center section via threaded connectors 86 into matching bores 87. The bottom section 84 is thereby a separate side cover bolted to the center section 82 to form the main body 80. The cover 74 is shown bolted to the housing body 80 of the housing 12 via threaded connectors 78 into matching bores 79.

As can be seen in FIGS. 3 and 4, the main body 80 contains the piston 62 and the spring 60. In FIG. 4, the piston 62 is shown in the center section 82, and the spring 60 is shown in the spring chamber 72 residing in the center section 82 and extending into the bottom section 84. Both of the side covers, that is, cover 74 and bottom section 84, may include bearings or bushings 88 that support the gear shafts 34, 36. Lateral end clearance may exist between the ends of the gear shafts 34, 36 and respective ends 90 of the channels 92 the bearings/bushings 88 fit into.

Still referring to FIG. 4, two different bearing units are shown as examples of lateral clearance pressure piston configurations to illustrate that the bearing units are not limited to any one example. In one example, the piston 62 presses against the bearing 88, which slides inside its bore, and presses the floating side plate 52 against the side of the gears 30, 32. FIG. 4 shows a second example of a bearing unit 94 housed in a chamber 96 of the center section 82. The bearing unit 94 includes a piston 98 that presses directly against the floating side plate 52. The bearing unit 94 further includes a compression spring 100 adapted to apply a bias against the adjacent piston 98. An o-ring 102 may be placed between the piston 98 and housing 12 to further prevent leakage.

The tunnel 70 is a drilled passageway connecting the chambers 96, 72 behind the pistons 98, 62 to the discharge side of the pump. As discussed above with piston 62, higher liquid pressure on the discharge side of the pump is transmitted through tunnel 70 to hydraulically actuate the piston 100 and further maintain a tight fitted relationship between the floating side plates 50, 52 opposite the gears 30, 32. While not being limited to a particular theory, the gear shaft 34 is a drive shaft extending out of the housing 12 for coupling to the pump motor. A grommet 104, preferably made of a resilient material (e.g., rubber, polypropylene, plastic, resin), is fitted within the housing 12 about the gear shaft 34 for providing a liquid seal therebetween.

It is understood that the elliptical gear pump fluid driving apparatus described and shown are exemplary indications of preferred embodiments of the invention, and are given by way of illustration only. In other words, the concept of the present invention may be readily applied to a variety of preferred embodiments, including those disclosed herein. While the invention has been described in detail and with reference to specific examples thereof, it will be apparent to one skilled in the art that various changes and modifications can be made therein without departing from the spirit and scope thereof. For example, the number, location, material and shape of the teeth, vanes, gears and floating fluid restricting plates described may be altered without departing from the scope of the invention. Without further elaboration the foregoing will so fully illustrate the invention that others may, by applying current or future knowledge, readily adapt the same for use under various conditions of service.

What is claimed is:

1. A pump fluid driving apparatus, comprising:

a housing having a first body plate with a first circular wall section and a second body plate with a second circular wall section, the first and second circular wall sections defining a chamber; and a first gear and a second gear identical to each other with said first and second gears mounted for rotation about their centers within said chamber and disposed adjacent, respectively, said first and second generally circular wall sections, said first and second gears having teeth located about their periphery and operatively positioned with said teeth of said first gear and said teeth of said second gear intermeshed for all angular positions in a rotation of said first and second gears, one of said teeth from said first gear and one of said teeth from said second gear both having a radially extending vane in sealing contact with the respective first and second generally circular wall sections said one of said teeth from said first gear and said one of said teeth from said second gear both including a vane slot extending radially within each of said one of first and second gears, each radially extending vane movable within said respective vane slot and extending radially beyond said respective one of said teeth.

2. The apparatus of claim 1, further comprising a biasing member disposed within said vane slot and against said radially extending vane, said biasing member configured to urge said radially extending vane toward said respective first or second generally circular wall section.

3. The apparatus of claim 1, said first gear and said second gear being oval in shape.

4. The apparatus of claim 1, said first gear and said second gear being oval in shape, with both first and second gears having a respective major diameter axis and said teeth located about the periphery in the region of the major axis being wider that said teeth about the periphery out of the region of the major axis.

5. The apparatus of claim 4, said teeth located about the periphery in the region of the major axis including said one of said teeth from said first gear and one of said teeth from said second gear, both of said teeth including a vane slot extending radially within each teeth, each radially extending vane movable within said respective vane slot and extending radially beyond said respective one of said teeth.

6. The apparatus of claim 1, said first gear and said second gear having helical teeth.

7. The apparatus of claim 1, said chamber within said first and second generally circular wall sections having a diameter greater than any diameter of said first and second gears.

8. The apparatus of claim 1, further comprising a floating side plate member laterally disposed about said first and second gears to seal off liquid within said chamber.

9. The apparatus of claim 8, said floating side plate member including a fluid restricting plate sealingly fitted against said chamber and a biasing unit urging said fluid restricting plate against said first and second gears.

10. The apparatus of claim 9, further comprising a second side plate member sealingly fitted to said chamber against said first and second gears opposite said floating side plate member.

11. The apparatus of claim 9, said first and second body plates being integral with the housing, said housing having a biasing member chamber adjacent the fluid restricting plate opposite the chamber defined by the first and second circular wall sections, the housing further comprising a tunnel between the chamber and the biasing member chamber providing fluid communication there between, the tunnel configured to automatically increase bias on the side plate during operation of the pump fluid driving apparatus and decrease bias after operation thereof.

12. The apparatus of claim 1, said teeth from said first and second gears defining gaps between adjacent teeth thereof, the one of said teeth from said first gear and the radially extending vane of the one of said teeth from said first gear both being intermeshed within only one gap of said second gear.

13. A fluid drive apparatus configured to increase output flow of low viscosity liquids by minimizing radial clearance slip path in a spur gear pump, said apparatus comprising a housing having a first body plate with a first circular wall section and a second body plate with a second circular wall section, the first and second circular wall sections defining a chamber, and identical first and second gears mounted for rotation about their centers within said chamber and disposed adjacent, respectively, said first and second generally circular wall sections, said first and second gears having teeth located about their periphery and operatively positioned with said teeth of said first gear and said teeth of said second gear intermeshed for all angular positions in a rotation of said first and second gears, one of said teeth from said first gear and one of said teeth from said second gear both having a vane extending radially beyond said teeth into sealing contact with the respective first and second generally circular wall sections, said vane moveable within the one of said teeth of said first gear to retreat when the one of said teeth of said first gear is meshed with said second gear.

14. The apparatus of claim 13, further comprising a vane slot extending radially within each of said first and second gears, each radially extending vane movable within said respective vane slot.

15. The apparatus of claim 14, further comprising a biasing member disposed within said vane slot and against said radially extending vane, said biasing member configured to urge said radially extending vane toward said respective first or second generally circular wall section.

16. The apparatus of claim 14, said first gear and said second gear being oval in shape, with both said first and second gears having a respective major diameter axis, said teeth located about the periphery in the region of the major axis being wider that said teeth about the periphery out of the region of the major axis.

17. The apparatus of claim 16, said teeth located about the periphery in the region of the major axis including said one of said teeth from said first gear and one of said teeth from said second gear, both of said teeth including a vane slot extending radially within each teeth, each radially extending vane movable within said respective vane slot and extending radially beyond said respective one of said teeth.

18. The apparatus of claim 13, further comprising a floating side plate member laterally disposed about said first and second gears to seal off liquid within said chamber, said floating side plate member including a fluid restricting plate sealingly fitted against said chamber and a biasing unit urging said fluid restricting plate against said first and second gears.

19. The apparatus of claim 18, further comprising a second side plate member sealingly fitted to said chamber against said first and second gears opposite said floating side plate member.

20. The apparatus of claim 18, said biasing unit including the low viscosity liquid.

21. The apparatus of claim 18, said first and second body plates being integral with the housing, said housing having a biasing member chamber adjacent the fluid restricting plate opposite the chamber defined by the first and second circular wall sections, the housing further comprising a tunnel between the chamber and the biasing member chamber providing fluid communication there between, the tunnel configured to automatically increase bias on the side plate during operation of the pump fluid driving apparatus and decrease bias after operation thereof.

22. The apparatus of claim 13, said first gear and said second gear having helical teeth.

23. The apparatus of claim 13, wherein said teeth from said first and second gears define gaps between adjacent teeth thereof, and said one of said teeth of said first gear and said vane within the one of said teeth of said first gear both mesh within only one gap of said second gear.

* * * * *